US007908309B1

(12) United States Patent
Macdonald

(10) Patent No.: US 7,908,309 B1
(45) Date of Patent: Mar. 15, 2011

(54) ANALOG WAVELET TRANSFORMER

(75) Inventor: Perry Macdonald, Newbury Park, CA (US)

(73) Assignee: HRL Laboratories, LLC, Malibu, CA (US)

( * ) Notice: Subject to any disclaimer, the term of this patent is extended or adjusted under 35 U.S.C. 154(b) by 1387 days.

(21) Appl. No.: 11/079,126

(22) Filed: Mar. 14, 2005

(51) Int. Cl.
*G06G 7/00* (2006.01)
*G06G 7/12* (2006.01)
*G06G 7/02* (2006.01)

(52) U.S. Cl. ..... 708/820; 708/800

(58) Field of Classification Search ..... None
See application file for complete search history.

(56) References Cited

U.S. PATENT DOCUMENTS 5,495,554 A * 2/1996 Edwards et al. ..... 704/205
2005/0105637 A1* 5/2005 Fitzpatrick et al. ..... 375/295

OTHER PUBLICATIONS

Daubechies et al. "Factoring Wavelet Transforms INTO Lifting Steps", Nov. 1977.*
Piella et al. "Adaptive Lifting Schemes With Perfect Reconstruction" IEEE Transaction On Signal Processing vol. 50, Jul. 2002.*

* cited by examiner

*Primary Examiner* — Lewis A Bullock, Jr.
*Assistant Examiner* — Mark A Gooray
(74) *Attorney, Agent, or Firm* — Christie, Parker, Hale

(57) ABSTRACT

A method of transforming an analog electrical signal into a wavelet transform. The analog electrical signal is input into a transmission line system as a transmission line input signal. A wavelet transform lifting is performed on the transmission line input signal to provide at least a first sum signal and a first difference signal of the transmission line input signal. The sum signal is designated as a first wavelet transform approximation signal and the difference signal is designated as a first wavelet transform detail signal.

16 Claims, 6 Drawing Sheets

- Analysis
  - P(n)=1,U(n)=1/2
    - $d_1[n]=d_0[n]-a_0[n]$
    - $a_1[n]=(a_0[n] + d_1[n])/2$ P is the predict step
U is the update step

ANALOG WAVELET TRANSFORMER

BACKGROUND OF THE INVENTION

Wavelets provide an alternative to classical Fourier methods for one- and multi-dimensional data analysis and synthesis, and have numerous applications both within mathematics and in areas as diverse as physics, seismology, medical imaging, digital image processing, signal processing and computer graphics and video.

A class of wavelet transforms was proposed by Daubechies in 1988. These transforms have signal processing properties that are complementary to Fourier transforms and provide an efficient way to characterize asynchronous signals. These transforms are typically performed on discrete time or sampled data. The simplistic view of the transform is that the signal is applied to a low pass and high pass filter, resulting in a detail signal output from the high pass filter, and an approximation signal output from the low pas filter. This transform can be recursively applied to the approximation signal, resulting in what is called a multi-resolutional analysis. One important characteristic of this transform is that the original signal can be recreated from the collection of detail signals and the lowest level approximation signal. The high and low pass filters have specific characteristics that allow an ideal reconstruction to occur. One of the several characteristics is that the filters, as viewed in the z domain, are Finite Impulse Response (FIR) filters with no transmission poles.

While wavelet transforms can provide an important role in signal processing, one requirement is that the signal be digitally sampled in order to apply the transform. At frequencies where efficient sampling hardware does not exist, there is a need for an approach whereby a wavelet transform can be performed without digitizing the signal. The present invention provides a solution to meet such need.

SUMMARY OF THE INVENTION

In accordance with the present invention, transmission lines are used to form required delays and to perform algebraic operations in the analog domain before any digital sampling is done. By using such an approach digital signal processing loads of large signal processing systems can be reduced by performing simple passive analog signal processing at an early stage.

In one aspect of the present invention a method of transforming an analog electrical signal into a wavelet transform is provided. The analog electrical signal is input into a transmission line system as a transmission line input signal. A wavelet transform lifting is performed on the transmission line input signal to provide at least a first sum signal and a first difference signal of the transmission line input signal. The sum signal is designated as a first wavelet transform approximation signal and the difference signal is designated as a first wavelet transform detail signal.

In another aspect of the present invention a method of transforming an analog electrical signal into a Haar wavelet transform is provided. The analog electrical signal is input into a transmission line system as a transmission line input signal. The transmission line input signal is power divided to provide a first power divided signal and a second power divided signal. The first power divided signal is electrically delayed to provide a third signal. The second power divided signal is electrically delayed to provide a fourth signal electrically delayed by twice that of the third signal. A sum signal is formed from the third signal and fourth signal and a difference signal is formed from the third signal and the fourth signal. The sum signal is designated as a wavelet transform approximation signal and the difference signal is designated as a wavelet transform detail signal.

In a still further aspect of the present invention, an analog wavelet transformer is provided. A transmission line power divider, such as a Wilkinson power divider, is responsive to an analog transmission line input signal and provides a first power divided signal and a second power divided signal. A first transmission delay line responsive to the first power divided signal electrically delays the first power divided signal to provide a third signal. A second transmission delay line responsive to the second power divided signal electrically delays the second power divided signal to provide a fourth signal electrically delayed by twice that of the third signal. A coupler, such as a rat-race coupler, is responsive to the third signal and the fourth signal and forms a sum signal from the third signal and fourth signal and a difference signal from the third signal and the fourth signal, the sum signal being output from the coupler as a wavelet transform approximation signal and the difference signal being output from the coupler as a wavelet transform detail signal.

The transmission line system may be a coaxial transmission line system, a microstrip transmission line system, a waveguide transmission line system, or other microwave transmission system.

DETAILED DESCRIPTION

Figure 1:
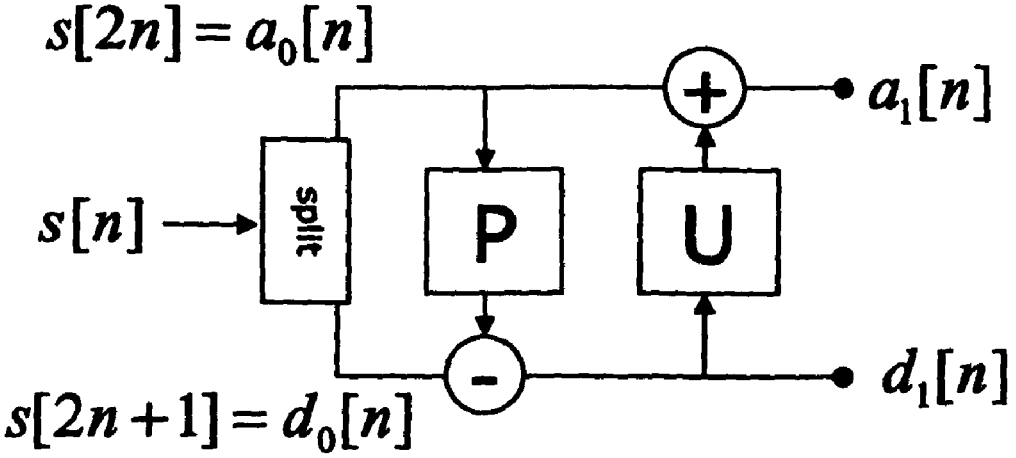
FIG. 1 (PRIOR ART)
FIG. 1 shows a prior art lifting calculation technique.

Wavelet transforms can be implemented in several ways, but the most efficient is the lifting method introduced by Sweldens. Sweldens proved that any FIR filter can be implemented using the lifting technique. A principal feature of the wavelet lifting technique is the use of simple invertible calculations using signal values, an example of which is shown in FIG. 1. The calculations provide simple sums and differences of the signal values. The present invention implements the lifting technique, but in an analog signal domain.

Figure 2:
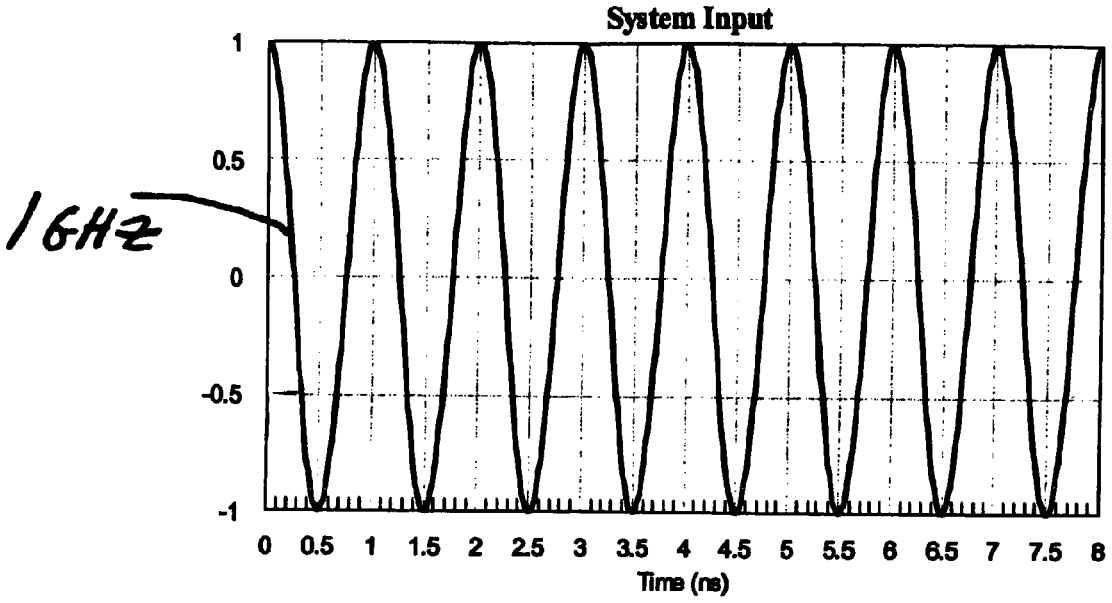
FIG. 2 shows an analog electrical signal which may be operated upon in accordance with the present invention.

Consider a 1 GHz analog signal as shown in FIG. 2. If the signal is sampled at the Nyquist rate (2 GHz), the waveform shown in FIG. 3 will be produced, with lines shown connecting the data points at the endpoints/peaks of each line segment. The lowest order transform proposed by Daubechies is also known as the Haar transform. The Haar wavelet transform of the FIG. 2 signal data (an alternating sequence of −1 and 1) would provide an approximation signal of 0 (the average) and a detail signal of −1 (the difference from the average). The same transform results can be achieved by utilizing embodiments of the present invention.

Figure 4:
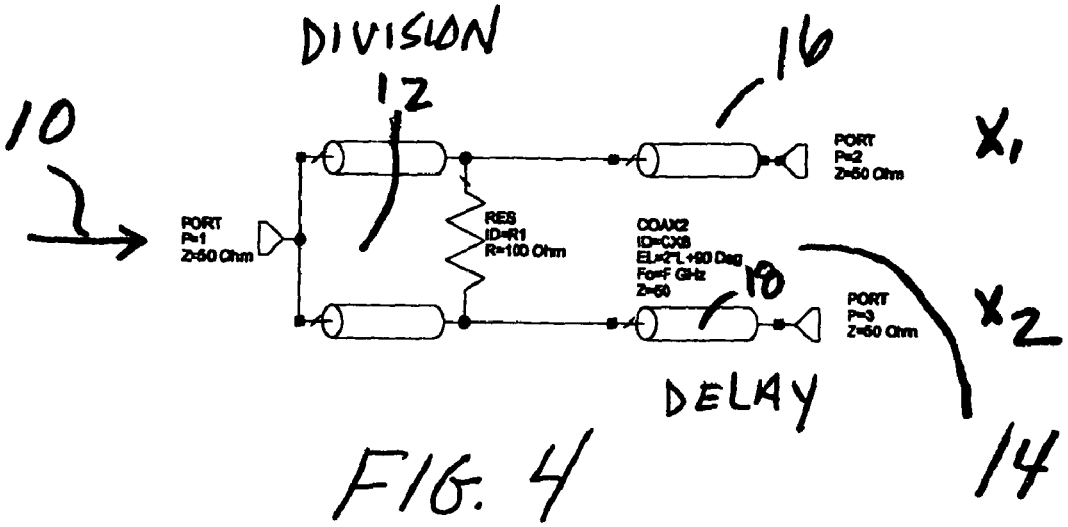
FIG. 4 is a schematic diagram of a division and delay circuit portion of an exemplary embodiment of the present invention.
Figure 5:
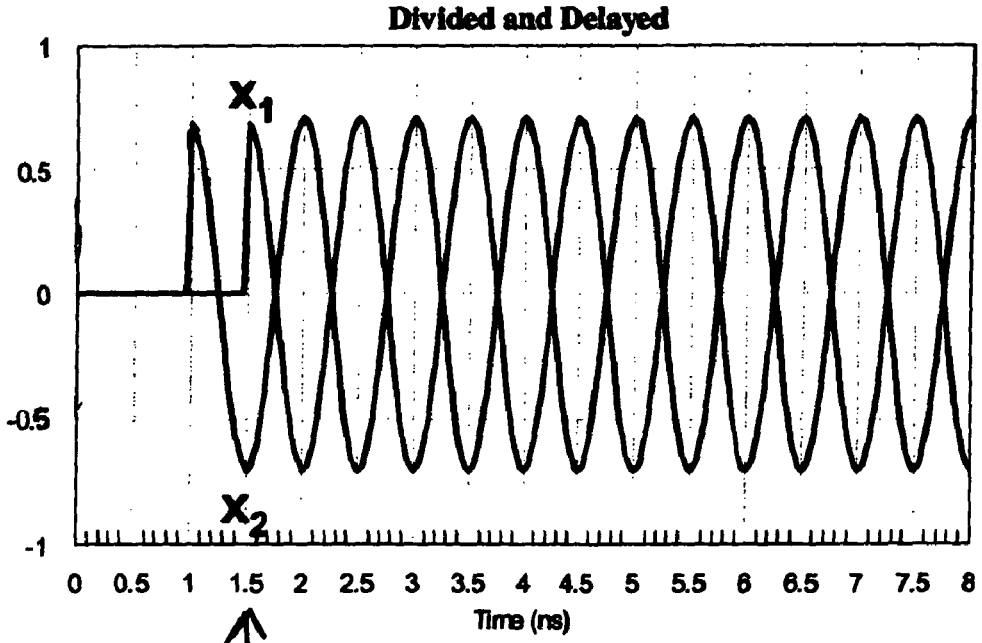
FIG. 5 shows a resultant signal output from the exemplary embodiment of FIG. 4.

Referring first to FIG. 4, in accordance with the present invention, an input signal 10 is input into a transmission line system and is first power divided 12 using, for example, in one embodiment a Wilkinson power divider. One path is delayed 14 by twice the other path, i.e., path 16 being delayed T(ns) of frequency (GHz) and path 18 being delayed 2 T (ns) of frequency (GHz), and respectively outputs signals $X_1$, $X_2$. This provides the ability for the signal values for signals $X_1$, $X_2$ to be compared at the same time, as shown in FIG. 5.

Figure 6:
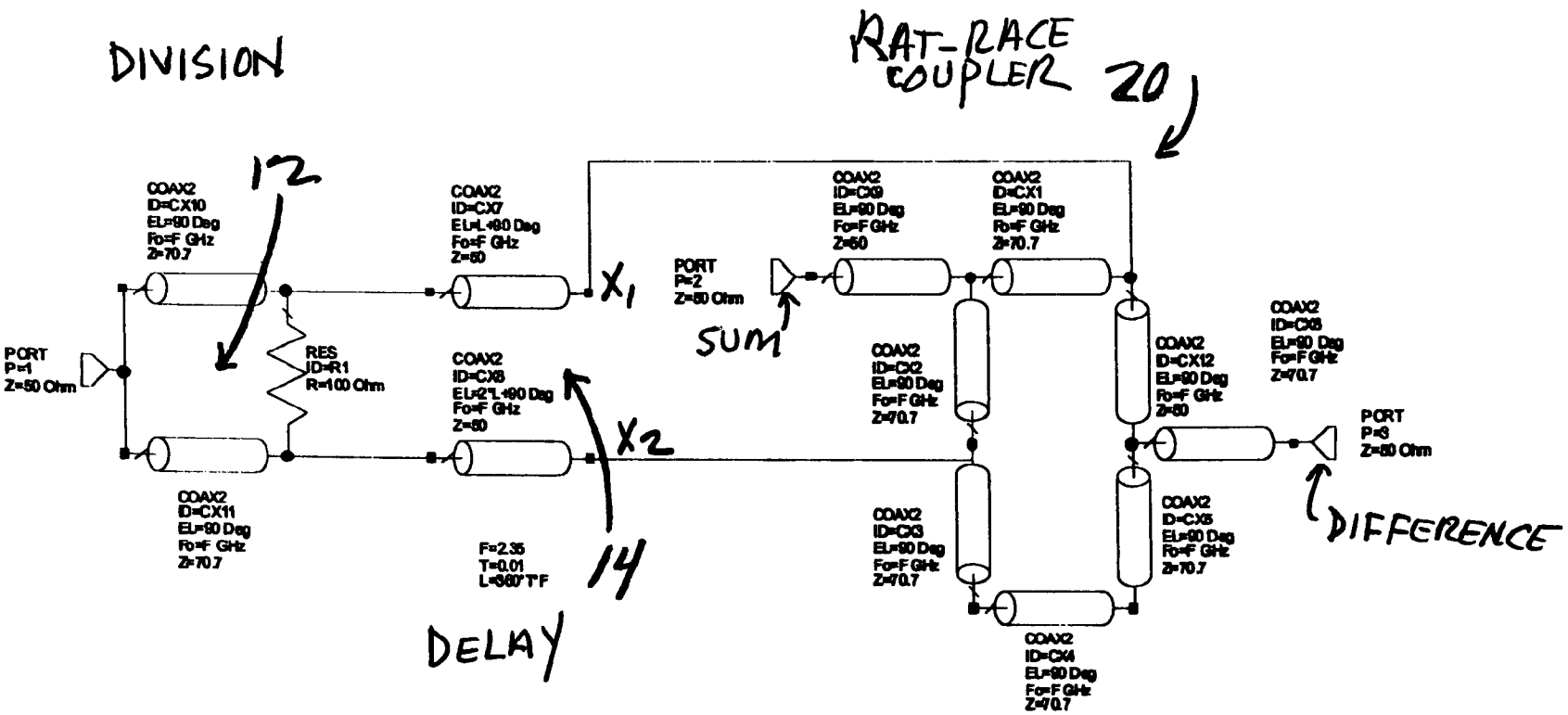
FIG. 6 is a schematic diagram of a division, delay and sum/difference circuit portion of an exemplary embodiment of the present invention.

Referring now to FIG. 6, wherein a further embodiment of the present invention is shown implemented in coaxial transmission lines. The divided and delayed waveforms of FIG. 4 are combined in the manner specified by the lifting technique set forth in FIG. 1 to calculate the approximation and detail waveforms. For the Haar transform, all that needs to be done is to take a sum and difference between the two signals. This is achieved using a 4 port quadrature coupler 20 responsive to the respective $X_1$, $X_2$ signals. The coupler 20, commonly known as a 'rat-race' or hybrid coupler, combines the signals in phase at one port and out of phase at the other port, and calculates the sum (wavelet transform approximation) and difference (wavelet transform detail) values.

Figure 3:
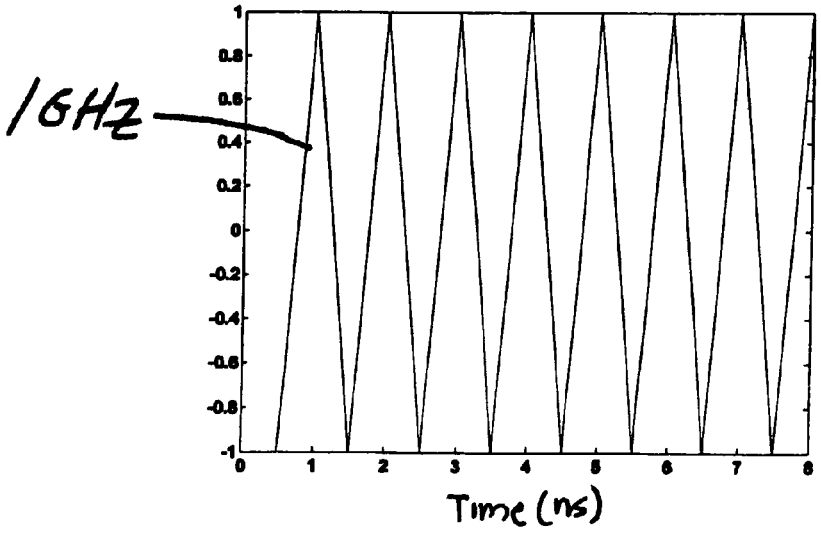
FIG. 3 depicts a sampled electrical signal.
Figure 7:
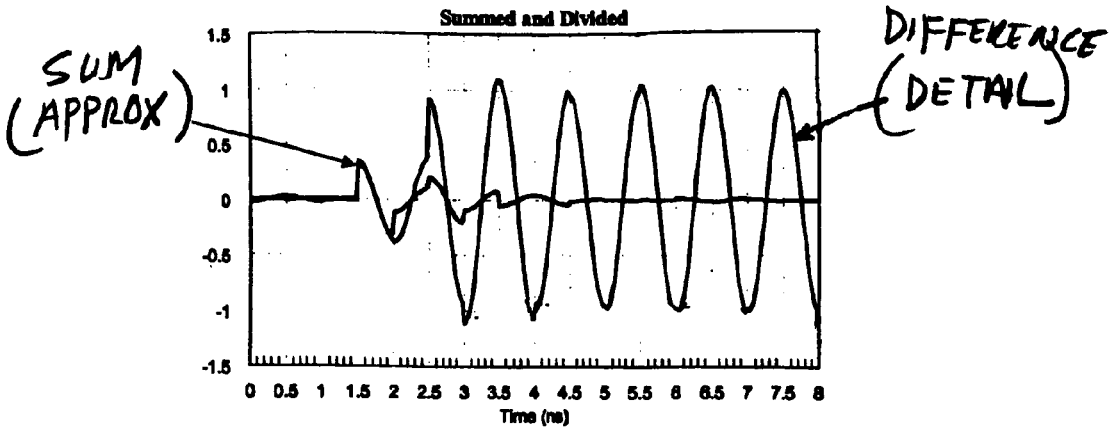
FIG. 7 shows a resultant signal output from the exemplary embodiment of FIG. 6.

From the plot in FIG. 7, which shows the sum and difference output results of the FIG. 6 circuit, it can be seen that the approximation and detail waveforms have the same values at the sample points as the approximation and detail coefficients provided from the sampled data in FIG. 3.

Figure 8:
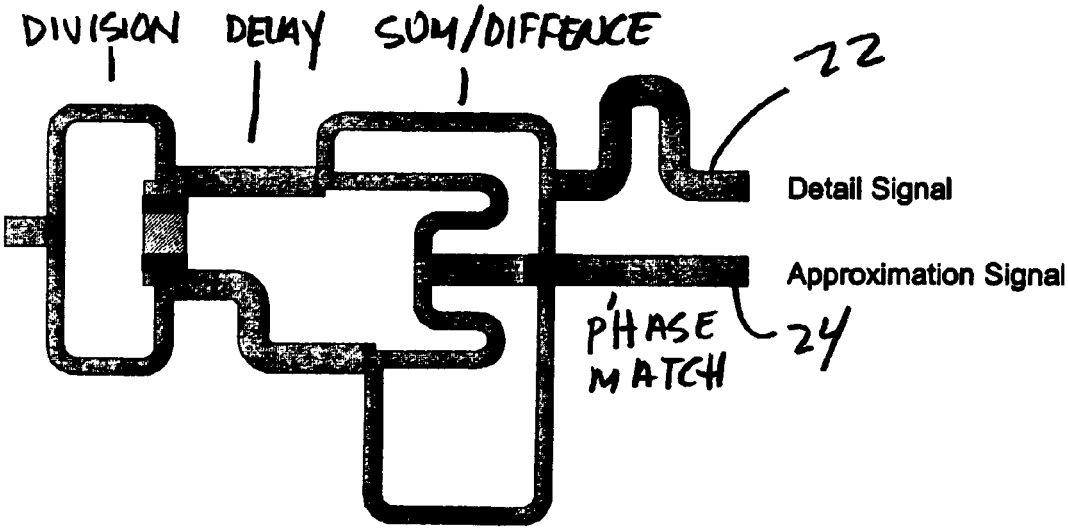
FIG. 8 is a plan view of a microstrip implementation of an exemplary embodiment of the present invention.

FIG. 8 shows a typical alternative microwave microstrip circuit layout which would similarly implement the characteristics of the division, delay, and sum and difference paths described in conjunction with the embodiment shown in FIG. 6. Additional phase matching lines 22, 24 are shown after the sum/difference operation to allow the resulting detail and approximation signals to both mechanically and electrically arrive at the same place and time for further processing. Those skilled in the art can appreciate that waveguides or other transmission lines can also be similarly implemented to practice the present invention.

Figure 9A:
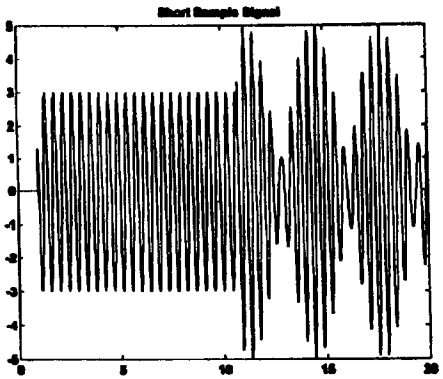
FIGS. 9A, 9B, and 9C are signal waveforms of a sample signal, software simulated wavelet transform signals, and analog output wavelet transform signals, respectively.
Figure 9C:
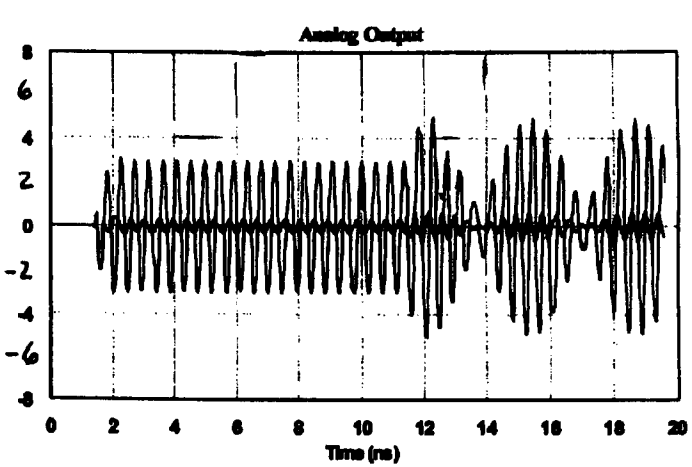
Figure 9B:
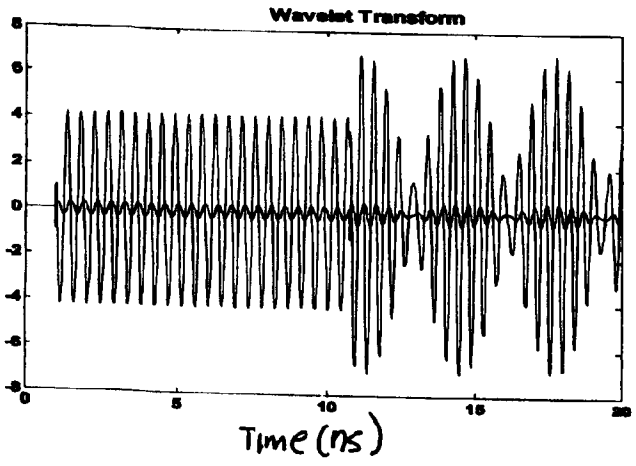

FIGS. 9A, 9B and 9C compare the results of a wavelet transform of a representative more complex waveform signal (FIG. 9A). A computer simulated wavelet transform of the FIG. 9A signal is provided in FIG. 9B. An analog output wavelet transform of the FIG. 9A signal is provided in FIG. 9C in accordance with an analog circuit implementation such as that shown in FIG. 6 or 8. As can be seen the analog implementation in accordance with the present invention produces a result comparable to that when using a mathematical wavelet transform software calculation.

Those skilled in the art can appreciate that while embodiments implementing a simple Haar wavelet has been discussed, more complex, higher order wavelets can be similarly implemented, wherein stages of transform circuitry would be cascaded in series for further more detailed processing, such as, for example, higher order wavelets which require additional additions and subtractions as dictated by the lifting technique.

What is claimed is:

1. A method of analog signal processing utilizing a signal processor comprising a transmission line system, the method comprising:

transforming an analog electrical signal into a wavelet transform in an analog domain by the transmission line system, the transforming comprising:

inputting the analog electrical signal into the transmission line system as an analog transmission line input signal;

performing an analog domain wavelet transform lifting on the analog transmission line input signal to provide at least an analog first sum signal and an analog first difference signal of the analog transmission line input signal; and designating the sum signal as a first wavelet transform approximation signal and the difference signal as a first wavelet transform detail signal.

2. The method of claim 1, wherein the transmission line system is a coaxial transmission line system.

3. The method of claim 1, wherein the transmission line system is a microstrip transmission line system.

4. A method of transforming an analog electrical signal into a Haar wavelet transform comprising:

inputting the analog electrical signal into a transmission line system as a transmission line input signal;

power dividing the transmission line input signal to provide a first power divided signal and a second power divided signal;

electrically delaying the first power divided signal to provide a third signal;

electrically delaying the second power divided signal to provide a fourth signal electrically delayed by twice that of the third signal;

forming a sum signal of the third signal and fourth signal and a difference signal of the third signal and the fourth signal; and designating the sum signal as a wavelet transform approximation signal and the difference signal as a wavelet transform detail signal.

5. The method of claim 4, wherein the transmission line system is a coaxial transmission line system.

6. The method of claim 4, wherein the transmission line system is a microstrip transmission line system.

7. The method of claim 4, wherein the power dividing is by a Wilkinson power divider.

8. The method of claim 4, wherein the sum signal and difference signal are formed by a rat-race coupler responsive respectively to an input of the third signal and the fourth signal to the rat-race coupler.

9. A signal processor comprising an analog wavelet transformer comprising a transmission line system adapted to perform an analog domain wavelet transform lifting on an analog transmission line input signal to provide at least an analog first sum signal and an analog first difference signal of the analog transmission line input signal, the analog first sum signal being designated as a first wavelet transform approximation signal and the analog first difference signal being designated as a first wavelet transform detail signal.

10. The signal processor of claim 9, wherein the transmission line system is a coaxial transmission line system.

11. The signal processor of claim 9, wherein the transmission line system is a microstrip transmission line system.

12. An analog wavelet transformer comprising:

a transmission line power divider responsive to an analog transmission line input signal to provide a first power divided signal and a second power divided signal;

a first transmission delay line responsive to the first power divided signal and adapted to electrically delay the first power divided signal to provide a third signal;

a second transmission delay line responsive to the second power divided signal and adapted to electrically delay the second power divided signal to provide a fourth signal electrically delayed by twice that of the third signal; and a coupler responsive to the third signal and the fourth signal and adapted to form a sum signal of the third signal and fourth signal and a difference signal of the third signal and the fourth signal, the sum signal being output from the coupler as a wavelet transform approximation signal and the difference signal being output from the coupler as a wavelet transform detail signal.

13. The analog wavelet transformer of claim 12, wherein the transmission line power divider, the first transmission delay line, the second transmission delay line, and the coupler are part of a coaxial transmission line system.

14. The analog wavelet transformer of claim 12, wherein the transmission line power divider, the first transmission delay line, the second transmission delay line, and the coupler are part of a microstrip transmission line system.

15. The analog wavelet transformer of claim 12, wherein the transmission line power divider comprises a Wilkinson power divider.

16. The analog wavelet transformer of claim 12, wherein the coupler is a rat-race coupler responsive respectively to an input of the third signal and the fourth signal to the rat-race coupler.

* * * * *